United States Patent [19]

Duncan

[11] Patent Number: 5,037,034

[45] Date of Patent: Aug. 6, 1991

[54] MICA DELAMINATOR

[75] Inventor: Donald H. Duncan, Spruce Pine, N.C.

[73] Assignee: J.M. Huber Corporation, Rumson, N.J.

[21] Appl. No.: 459,528

[22] Filed: Jan. 2, 1990

[51] Int. Cl.[5] ..... B02C 19/12

[52] U.S. Cl. ..... 241/247; 241/4; 241/278 R; 241/284

[58] Field of Search ..... 241/4, 21, 65, 23, 248, 241/199.9, 202, 199.12, 246, 247, 186 A, 284, 278 R

[56] References Cited

U.S. PATENT DOCUMENTS 2,547,336 4/1951 McDaniel et al. ..... 241/4

3,164,330 1/1965 Neidl ..... 241/186 A 3,416,740 12/1968 Hodgson et al. ..... 241/21

FOREIGN PATENT DOCUMENTS 1222508 2/1971 United Kingdom .

*Primary Examiner*—Mark Rosenbaum

*Attorney, Agent, or Firm*—Harold H. Flanders; Alec H. Horn; Robert L. Price

[57] ABSTRACT

A mica plate delaminator has a delaminating cylindrical chamber with a flat disk mounted on a drive shaft at a 65 degree angle to the shaft. A screw feeder feeds material from a hopper into the delaminating chamber and the disc is rotated at 600–1200 rpm to force the mica back and forth over itself and the clearance between the disc and the housing to a discharge, delaminating the mica plates to small flakes.

7 Claims, 3 Drawing Sheets

MICA DELAMINATOR

BACKGROUND OF THE INVENTION

This invention relates to the delaminating of mica "plates" into small "flakes" for use as additives in various industrial applications. As with most minerals, mica is mined and then processed into a form suitable for the intended use. Heretofore, this generally has involved "cleaning" of the mined mica, preliminary crushing of the ore and then separating the usable product from contaminants, unusable fines, etc., by milling or other time and energy consuming processes. For instance, in some of the prior art, time of processing is described as many hours or even days. The difficulty, energy required, and costs involved have been great and the yield of suitable product low with prior devices and processes.

Patents showing various processes noted in a preliminary search include: U.S. Pat. Nos. 3,416,740; 2,547,336; 3,432,030; 533,384; 2,999,649; 2,204,063; and British patent 1,222,508.

U.S. Pat. No. 3,416,740 to Hodgson appears to applicant to be the closest prior art. The impeller in the drawings of Hodgson is inclined at a much greater angle, has a number of holes in it, is fed by a pump, and specifies the use of a milling medium. The present invention uses no "medium", uses a fixed volume feed, has the impeller mounted at a much smaller angle to the drive shaft, uses a hexagonal delaminating chamber in one embodiment, and uses the heat of separation to produce steam for facilitating the process, all of which results in a more efficient and cost effective machine and process as will become apparent from the following detailed description.

The other patents cited show various older attempts to separate and refine clay, mica and $TiO_2$ by involved processes requiring chemical treatment, high velocity agitation, and extensive grinding in aqueous solutions. The yield and power required to operate these systems have generally prevented them from becoming commercially successful.

The present invention permits continuous operation versus the batch operation of the prior art and also results in a reduction in horsepower and time required to produce a 250 percent increase in efficiency from reduction in horsepower and time required to produce one pound of finished product.

SUMMARY OF THE INVENTION

It is therefore an object of the present invention to provide an apparatus and method wherein the difficulties of the prior devices and processes are reduced or eliminated.

It is another object of the present invention to provide an improved mica plate delaminator that is capable of greatly increased output at significantly reduced power requirements.

It is a further object of the present invention to provide an apparatus, for delaminating mica plates into small "flakes", of a simplified construction that is easy to operate and maintain and has a minimum number of interacting parts and controls.

These and other further objects of the present invention will become apparent from the following summary and detailed description.

The mica plate delaminator of the present invention consists of a cylindrical chamber fed from a screw conveyor, a shaft extending into the cylindrical delaminating chamber, a flat disk impeller mounted on the end of said shaft in the delaminating chamber, an input hopper disposed to feed material to be delaminated into said chamber, a cooling water jacket surrounding the delaminating chamber and a motor to rotate the shaft.

In operation a hopper is filled with mica material to be delaminated. This material is fed from the hopper via a screw feeder to the delaminating chamber. Water is added as necessary to permit efficient mixing and delamination.

The delaminating disc separates the mica into small flakes through a combination of compression, tumbling, sliding, and frictional action on the mica plates accentuated by the small sixty-five degree angle between the disc and shaft. The separate small flakes are discharged from the device through an appropriate opening in the outboard face of the delaminating chamber.

During the delaminating process a large amount of heat is generated which results in a temperature in the delaminating chamber of at least two hundred forty degrees Fahrenheit. This heat turns at least a portion of the water in the mixture being fed into the device into steam, which facilitates and enhances the delaminating of the mica plates during the above mentioned physical torturing of the mica plates. Cooling water is circulated through a jacket surrounding the delaminating chamber as required to maintain the desired temperature.

DETAILED DESCRIPTION OF THE PREFERRED EMBODIMENT

Figure 1:
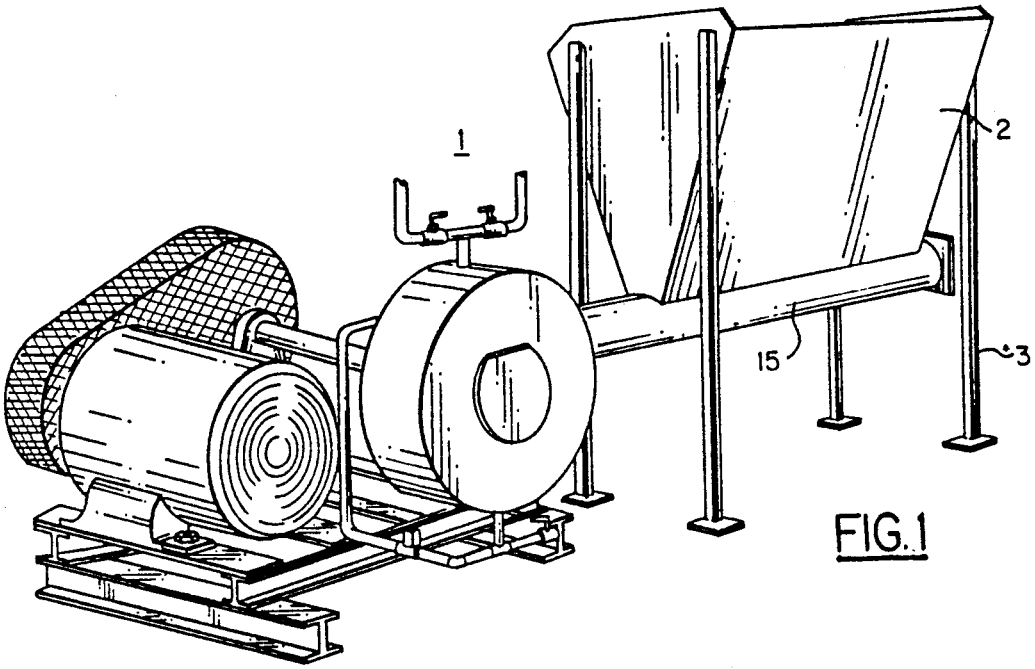
FIG. 1 is a perspective view of one embodiment of this invention.
Figure 2:
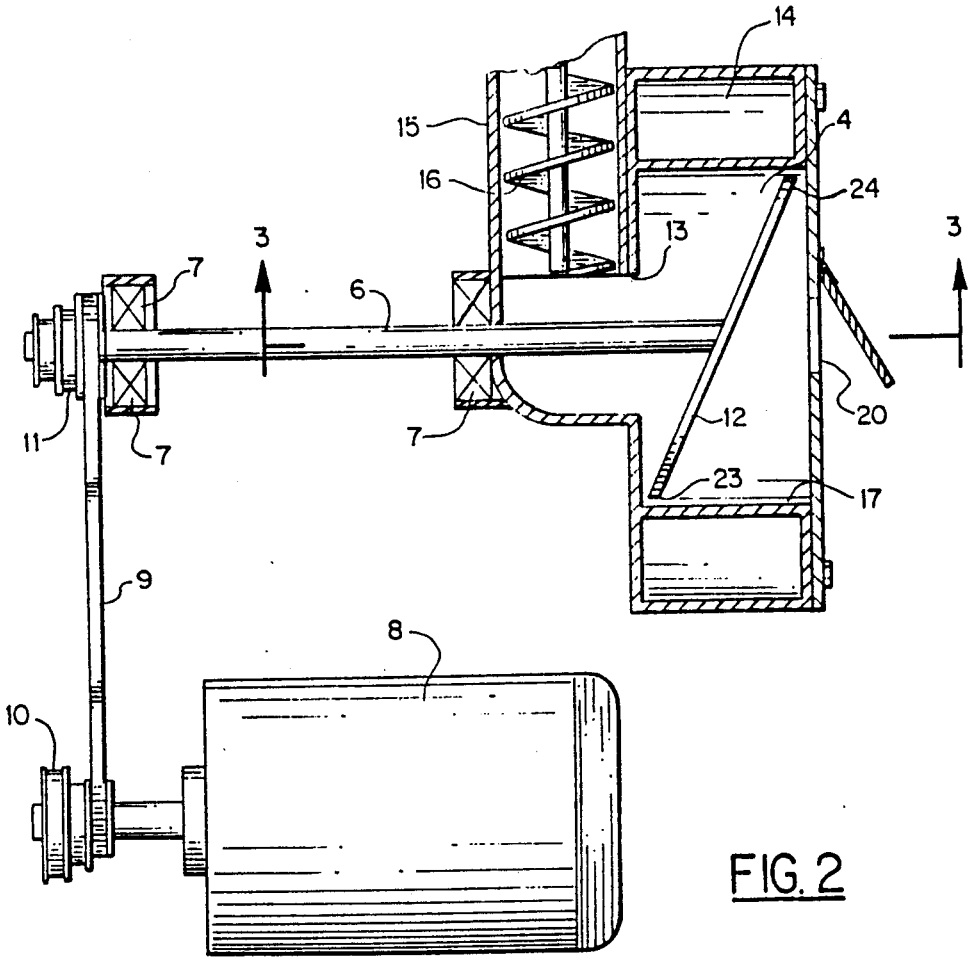
FIG. 2 is a partial horizontal view of the device of FIG. 1 with the housing shown in section.
Figure 3:
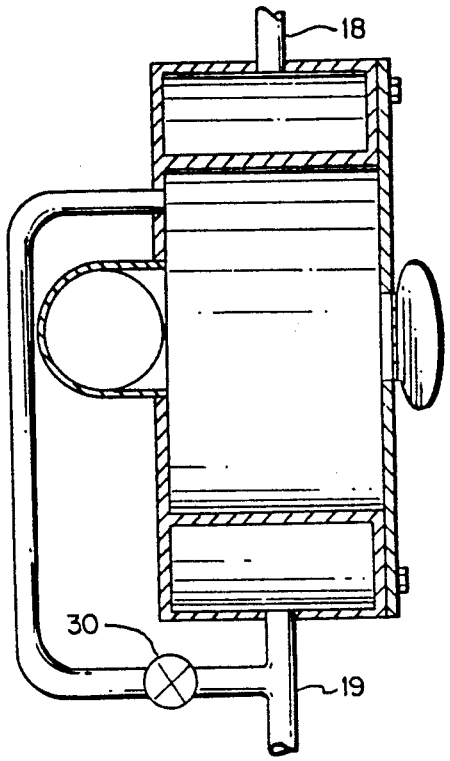
FIG. 3 is a sectional view on line 3—3 of FIG. 2.

Referring now to FIGS. 1-3, the delaminator 1 consists of a hopper 2, mounted on legs 3 to elevate the bottom of the hopper to proper elevation to feed material into the delaminating chamber 4, via feeder 15 and feeder screw 16, drive shaft 6, mounted in bearings 7, (shown schematically) and driving motor 8 arranged to drive shaft 6 through belt 9 and pulleys 10 and 11. Shaft 6 extends into delaminating chamber 4 and has delaminating disc 12 mounted thereon. Disc 12, in one embodiment, is mounted on the end of shaft 6 at an angle of sixty-five degrees to the axis of shaft 6.

Conveyor screw 16 feeds material from hopper 2 through opening 13 into delaminating chamber 4. Delaminating chamber 4 is surrounded by a water cooling jacket 14 to allow the temperature in the chamber to be maintained at the desired temperature. Suitable cooling fluid—normally water, may be introduced through pipe 18 and discharged through pipe 19 (FIG. 3). Preferably a portion of the warm water from pipe 19 is used as make up water for the mixture in delaminating chamber 4. Water is added to allow uniform and continuous mixing of the mica introduced from hopper 2. If the mixture is too dry, the power required increases and improper mixing occurs. Normally addition of water is controlled by solenoid valve 30 which is actuated when the current drawn by motor 8 exceeds a preset level. The delaminating chamber 4, shaft 6, and drive motor 8 are mounted on a suitable frame and with legs 3 on the hopper adjusted to permit feeding of material from the hopper through screw feeder 15 through opening 13 into the chamber 4.

The screw 16 within feeder 15 is driven by any convenient means such as a motor, not shown. The diameter, pitch and rpm of screw 16 are chosen to maintain the input side of chamber 4 full at all times so as to provide a fixed volume of fed material to chamber 4 and maintain a predetermined feed pressure on the material to be delaminated. It has been found that having the feeder smaller in diameter than the delaminator chamber 4 facilitates the pressure build-up and improves the delaminating action.

Figure 7:
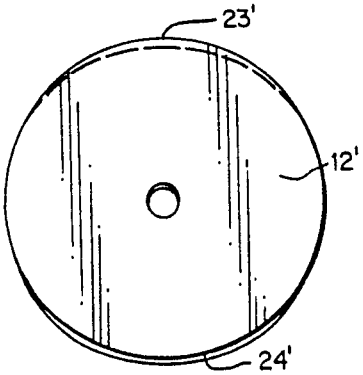
FIG. 7 is a plan view of the delaminating disc.

As may be seen in FIGS. 2 and 7, the delaminating disc edges 23–24 are tapered at diametrically opposed segments of approximately thirty degrees so as to conform to the inner surface of the outer shell of the delaminating chamber 4 during revolution. The angle of taper of these edges 23 and 24 varies from sixty-five degrees (as the delaminating disc 12 is mounted relative to the shaft 6) at a first diameter, to zero at a diameter displaced ninety degrees from the first diameter. This results in a constant clearance of the desired magnitude between the disc edge and housing of chamber 4 as disc 12 is rotated. The clearance between disc 12 and housing 17 is chosen along with the feed pressure and material viscosity to give the desired final mica flake size consistent with the desired speed of operation and product yield. In one embodiment, a clearance of one-half inch has been found satisfactory.

The clearance for screw 16 is chosen for easy operation and feeding of the material to be delaminated from the hopper to chamber 4.

This fixed feed volume and pressure forces the mica "plates" over each other and the edge of the disc 12 during the rotation of disc 12 causing them to be delaminated by a combination of bending, frictional sliding, rotation, and compression between individual particles of material, and between the particles of material and disc 12, and the chamber housing 7. This results in the plates of mica being delaminated into the desired small flakes rather than being ground or milled into a powder.

As the mica plates are delaminated, a significant amount of heat is generated. Much of the heat must be removed by cooling fluid in the cooling jacket, but some of this heat is used to turn the water content of the material to be delaminated into steam. The initial water content of the mica material is adjusted for efficient mixing and maintained at this level by the control described above. The temperature in the delaminating chamber is held at two hundred forty degrees Fahrenheit by the cooling water in jacket 14. This results in some of the water being turned into steam which facilitates the separation of the layers of the mica plates and also lubricates the movement of the particles, one against the other.

The process of the present invention starts with the introduction of the mica material to be delaminated into hopper 2. This has a bulk-density of approximately thirty pounds per cubic foot in the dry state. The usual mix contains widely varying particles from fines to approximately three inches across. This material is further prepared for delamination by adding water in chamber 4 until a mixture of approximately sixty percent solids in the delaminating chamber is obtained.

The dry mixture is fed from the hopper 2 via feeder 15 to the chamber 4. As indicated previously, the feeder screw 16 is sized and operated to feed material into the delaminating chamber 4 at a positive, fixed volume and pressure. This keeps the first half of delaminating chamber 4 full at all times. During one revolution, delaminating disc 12 is forced from the position shown in FIG. 1 to the exact reverse and back again. In effect, disc 12 oscillates back and forth through the material in chamber 4 about the end of the shaft 6 forcing some of the material vertically downwardly through other material and some material over the edges of disc 12 through the one-half inch clearance mentioned above.

The delaminator disc 12 is rotated at a speed sufficient to produce the desired mica delamination and particle size within the limits of the set clearance and angle of the disc 12. In a preferred embodiment, speeds of 600 to 1200 RPM have been used with the clearance shown at 18 in FIG. 4, preferably in the range of one-half inch. It has been found that the material on average, resides in chamber 4 from twenty-four minutes to twelve minutes, depending on the RPM of disc 12.

The delaminated mica particles are discharged through exit opening 20 in the outer wall of the delaminator chamber 4 and collected in any suitable container. The mica particles discharged from exit 20 have very little moisture associated with them and are ready for further processing.

The discharge opening 20 is shown as being concentric with shaft 6 and approximately one-and-one-half inches to three inches in diameter where the delaminator chamber is approximately twenty four inches in inside diameter. The right side of chamber 4 in FIG. 2 thus is maintained approximately one-half full. A hinged cover 21 is provided to close exit 20 when material is not being discharged.

Figure 9:
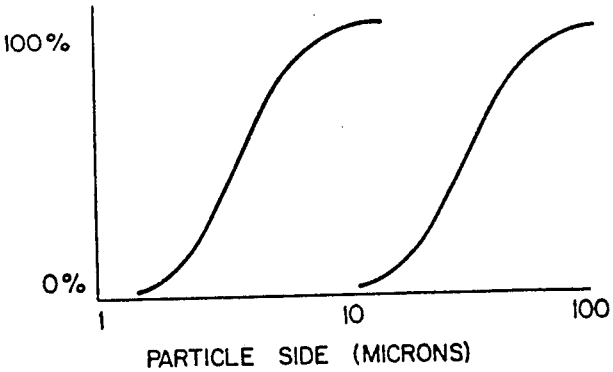
FIG. 9 shows the particle size distribution for the crude and finished product.

Delamination, once the apparatus achieves operating speed and temperature, appears to produce a delaminated mica flake product of sixty-five percent to forty-nine percent solids of three-hundred-twenty-five mesh at a rate of approximately 700 to 1400 pounds per hour. The yield will vary depending on the rate of feeding and the RPM of the disc 12. The resulting bulk-density of the product is approximately eight pounds per cubic foot as compared to standard mulled product, bulk density of twelve pounds per cubic foot. Typical particle size distribution curves are shown in FIG. 9 for the crude ore and finished product.

The lighter bulk-density of the finished product of the present invention results in a superior "mica flake" product which produces superior results to milled and ground products when used as a filler in paints, plastics and the like.

With the foregoing apparatus, it has been found that the electricity required to process a pound of mica plates is greatly reduced. In the embodiment shown, an electric motor of seventy-five horsepower has been found to be adequate to produce 700–1400 pounds per hour of delaminated mica flakes. This is approximately forty to fifty percent of the size of prior art motors used to produce this quantity of delaminated material.

Figure 4:
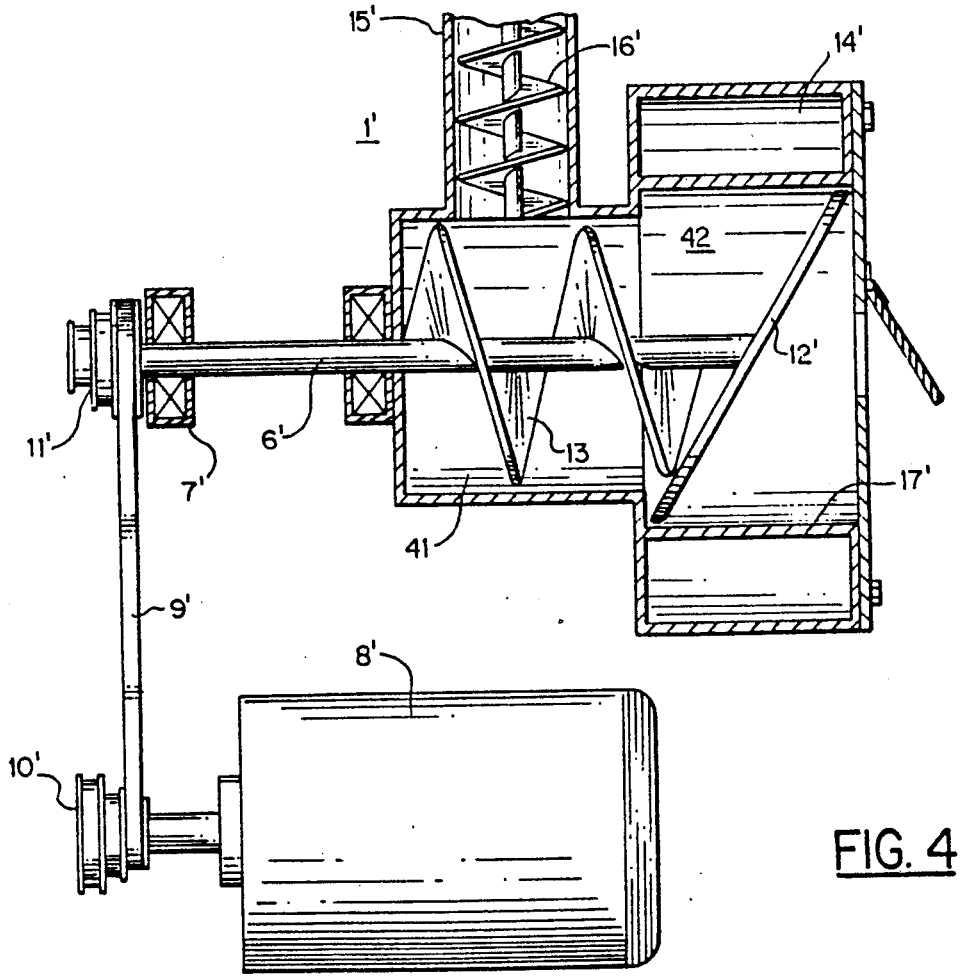
FIG. 4 is a view similar to FIG. 2 of another embodiment of the invention.
Figure 6:
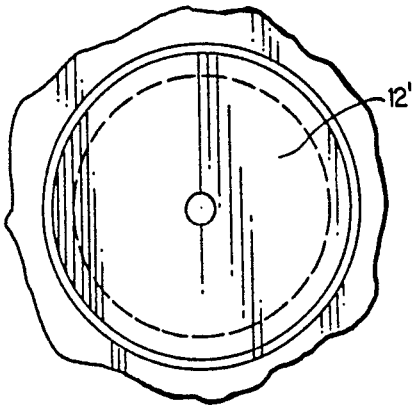
FIG. 6 is a sectional view on line 6—6 of FIG. 5.
Figure 5:
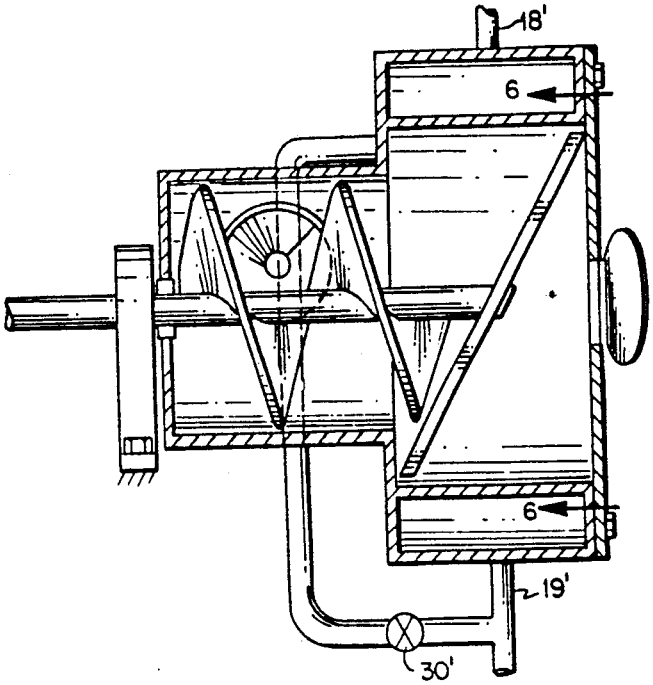
FIG. 5 is a sectional view on line 5—5 of FIG. 4.

Referring now to FIGS. 4–6, the delaminator 1′ consists of a hopper (not shown), and screw feeder 16′ to feed material into the delaminator feeder chamber 41, a delaminating chamber 42, drive shaft 6' mounted in bearings 7', (shown schematically) and driving motor 8' arranged to drive shaft 6' through belt 9' and pulleys 10' and 11'. Shaft 6' extends through feeder chamber 41 into delaminating chamber 42 and has delaminating disc 12 mounted on the end thereof. Disc 12', in one embodiment, is mounted on the end of shaft 6' at an angle of sixty-five degrees to the axis of shaft 6'. Screw feeder 13 in chamber 41 is also mounted on shaft 6'.

Feeder chamber 41 receives mica from conveyor screw 16' and directs it into delaminating chamber 42. Delaminating chamber 42' is surrounded by a water cooling jacket 14' to allow the temperature in the chamber to be cooled to the desired point. Suitable cooling fluid—normally water, may be introduced through pipes (not shown) for this purpose. Preferably, a portion of the warm water discharged from jacket 14' is used as make up water for the mixture in the delaminating chamber. Water is added to allow uniform and continuous mixing of the mica introduced from hopper as in the prior embodiments. Material from the hopper is fed through screw feeder 15' into the delaminator feeder chamber 41 at a point above the center line of screw 13. The material is introduced into feeder chamber 41 in the feed direction of screw 13 as shown more clearly in FIG. 5.

The screw 16' within feeder 15' is driven by any convenient means such as a motor, not shown. The diameter, pitch and rpm of screw 16' are chosen to maintain feeder chamber 41 full at all times so as to provide a fixed volume of material to be delaminated for chamber 42. It has been found that having the feeder smaller in diameter than the delaminator chamber facilitates the pressure build-up and improves the delaminating action.

As may be seen in FIGS. 4 and 7 the delaminating disc edges 23'–24' are tapered as shown in the earlier embodiment. The clearance between disc 12' and housing 17' is chosen along with the feed pressure to give the desired final mica flake size consistent with the desired speed of operation and product yield. In one embodiment, a clearance of one-half inch has been found satisfactory.

This fixed feed volume and pressure forces the mica "plates" over the edge of the disc 12' during the rotation of disc 12' causing them to be delaminated by a combination of bending, frictional sliding, milling, and compression between the particles of material, disc 12', and the chamber 42 housing. This results in the plates of mica being delaminated into the desired small flakes rather than powdered.

Figure 8:
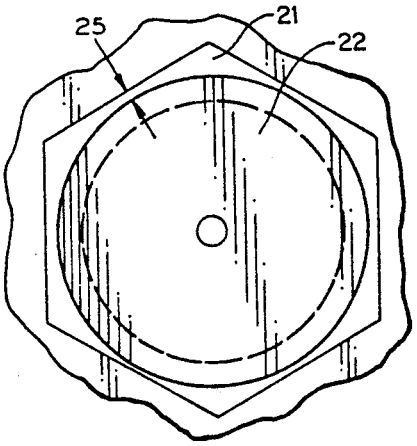
FIG. 8 is a view similar to FIG. 6 of another embodiment of the present invention.

Referring now to FIG. 8, there is shown another embodiment of the present invention wherein the delaminating chamber 21 has a hexagonal cross section rather than round. The delaminating disc 22 is circular and chosen with a diameter such that the clearance at the "tangent" point of the sides of the hexagonal chamber is one-half inch as indicated at arrows 25.

In this embodiment, it has been found that for certain types of mica mixtures and desired final particle sizes, the larger apertures at the hexagonal corners permit a "fold over" of the mix resulting in a greater yield of end product for the same power input.

While this invention has been explained with reference to the structure disclosed herein, it is not confined to the details as set forth and this application is intended to cover any modifications and changes as may come within the scope of the following claims.

What is claimed is:

1. An apparatus for delaminating mica and other mineral like materials comprising in combination a first cylindrical delaminating chamber;

a second cylindrical material feeder chamber having a diameter less than the diameter of said first chamber positioned in coaxial alignment with said first chamber;

a shaft extending through said second chamber into said first chamber;

a delaminator disc mounted on said shaft in said first chamber to divide said first chamber into equal input and output portions;

means for supplying material to be delaminated to said second chamber;

a material screw feeder fixed on said shaft in said second chamber, said screw feeder having a pitch and diameter sufficient to keep the input portion of said first chamber full of material to be delaminated as said feeder and delaminating disk are rotated by said shaft;

means for rotating said shaft to delaminate material in said first chamber;

a discharge outlet connected to said output portion of said first chamber so that upon rotation of said shaft, material fed into said input portion of said first compartment will be delaminated and forced into said output portion of said first compartment for discharge through said discharge outlet.

2. An apparatus according to claim 1 wherein said material screw feeder has a unit displacement volume greater than one half the volume of said first chamber.

3. An apparatus as defined in claim 2 in which said displacement is between 30 and 35 percent greater than one-half the volume of the first chamber.

4. An apparatus according to claim 1 wherein said discharge outlet is an orifice in said first chamber wall in coaxial alignment with said shaft.

5. An apparatus as defined in claim 1 in which the edge of said delaminating disc at one end of a first diameter is cut at an angle to the plane thereof equal to the angle of said disc to the axis of the shaft, said angle being oppositely cut at the other end of said first diameter and tapering to zero angle at each end of a second diameter displaced 90 degrees from said first diameter.

6. An apparatus as defined in claim 1 in which said delaminating disc is a flat, circular plate mounted on said drive shaft at an angle of 50 to 70 degrees to the axis thereof.

7. An apparatus as defined in claim 1 wherein said disc is mounted on the end of said drive shaft at an angle of 65 degrees to the axis of said shaft.

* * * * *